US009651233B2

(12) United States Patent
Briggs

(10) Patent No.: US 9,651,233 B2
(45) Date of Patent: May 16, 2017

(54) MODE OF ACTUATION FOR FLASHLIGHT SWITCHES

(71) Applicant: David Lloyd Briggs, Haltern (DE)

(72) Inventor: David Lloyd Briggs, Haltern (DE)

( * ) Notice: Subject to any disclaimer, the term of this patent is extended or adjusted under 35 U.S.C. 154(b) by 0 days.

(21) Appl. No.: 14/671,016

(22) Filed: Mar. 27, 2015

(65) Prior Publication Data

US 2016/0281970 A1 Sep. 29, 2016

(51) Int. Cl.
*F21L 4/00* (2006.01)
*F21V 23/04* (2006.01)

(52) U.S. Cl.
CPC ..... *F21V 23/0428* (2013.01); *F21L 4/005* (2013.01); *F21V 23/0407* (2013.01)

(58) Field of Classification Search
CPC .. F21V 23/0428; F21V 23/0407; F21V 21/32; F21V 23/0414; F21L 4/005; F21L 4/04; F21Y 2101/02; F21S 9/02
USPC ..... 362/189, 198, 202, 183, 157, 398, 285, 362/197, 418
See application file for complete search history.

(56) References Cited

U.S. PATENT DOCUMENTS

| | | | | |
|---|---|---|---|---|
| 5,176,438 | A * | 1/1993 | Fisherman | 362/99 |
| 6,520,660 | B1 * | 2/2003 | Ho | 362/171 |
| 7,674,003 | B2 * | 3/2010 | Sharrah | H01H 13/503 362/202 |
| 2009/0129069 | A1 * | 5/2009 | Grossman | H01M 8/2475 362/189 |

* cited by examiner

*Primary Examiner* — Andrew Coughlin
*Assistant Examiner* — Jessica M Apenteng

(57) ABSTRACT

A mode of actuation for electrical switching is disclosed which uses bending of a longitudinal body, such as a cylindrical flashlight, to close and open an electrical circuit, whereby bending can be in any direction. This invention intends to increase the usefulness of flashlights by exploiting the ease of bending compared to the modes of switch actuation used hitherto since it can be performed under unfavorable circumstances such as darkness, when the fingers are numb from cold or when the user is wearing thick, protective gloves, also when only one hand or other body part is available for switching, since this action requires only rudimentary dexterity. One of various possible embodiments of the invention is described to illustrate the concept.

8 Claims, 2 Drawing Sheets

MODE OF ACTUATION FOR FLASHLIGHT SWITCHES

BACKGROUND OF THE INVENTION

Hand-held, battery-powered lighting devices, called flashlights in the US or torches in the UK and known as penlights in their smaller versions, are turned on and off by means of switches. These switches vary according to their design and, dependent thereon, the ease with which they can be used, that is, how readily the switch can be found, for example by feel in the dark and how easily it can be actuated, especially when the user's hands are numb from cold or handicapped by thick gloves, and whether the light can be turned on and off with only one hand.

In the case of the predominant cylindrical flashlights, with which the following is concerned, switching is most commonly actuated by means of sliding and/or pressure-sensitive devices on a side of the flashlight. Another way to open and close the circuit is by rotating either one of the end members. Such rotational manipulations may require two hands, especially in the case of larger devices. A further alternative is a pushbutton switch on the end of the flashlight opposite the light. This last variant is found mainly on small flashlights or penlights, where it affords an improvement in ease of use over the other alternatives. However, the position of the hand and of the flashlight itself is often awkward. Use of such pushbutton switches on the ends of larger flashlights aggravates the disadvantages of this switching arrangement.

BRIEF SUMMARY OF THE INVENTION

The object of the present invention is to facilitate the switching of flashlights by introducing a new mode of actuation of switching the light on and off, namely by bending the body of a cylindrical flashlight in any direction. Since this action requires only rudimentary dexterity and is easily performed, even under unfavorable conditions, flashlights made according to the invention will often be more convenient to use than those with other modes of switching. In the case of penlights, bending can be performed with one hand, without need to find a particular feature on the device; several fingers can hold the flashlight and the thumb can bend it, in any direction, to switch the light on and off. In the case of larger flashlights, switching can be achieved by bending the device, in any direction, by pressing it against the surface it is lying on (see FIG. 3) or by pressing it against the body of the user; both of these actions are possible by using only one hand, foot or arm, even when the user is wearing thick, protective clothing.

An embodiment is described in order to illustrate the concept of bending the flashlight or other longitudinal body in an arbitrary direction to effect electrical switching; this embodiment serves as an example only and does not limit the invention to the means described for its realization.

DETAILED DESCRIPTION OF THE INVENTION

Figure 1:
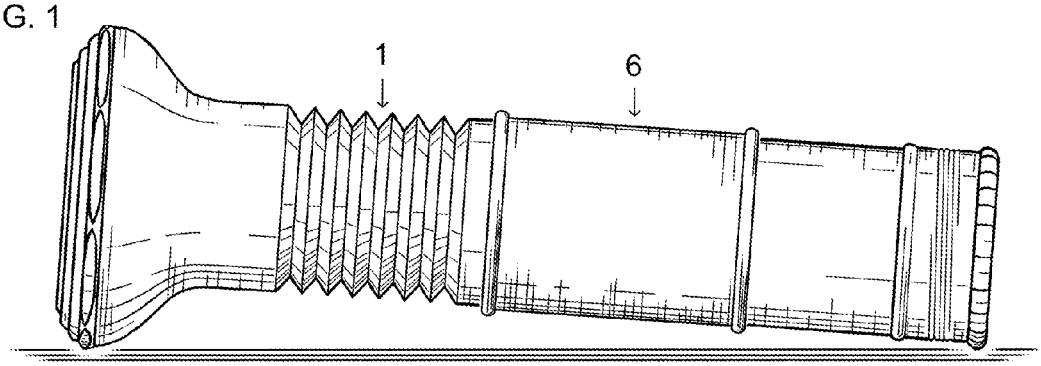
FIG. 1 is a side view of a flashlight in the resting position with the sliding sheath 6 retracted to expose the flexible section 1.
Figure 2:
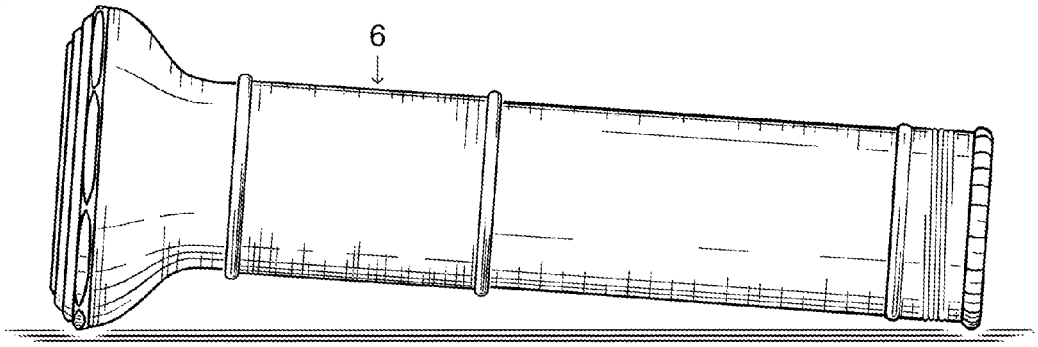
FIG. 2 is a side view of the flashlight with the sliding sheath 6 pushed forward to prevent inadvertent bending of the flexible section 1.
Figure 3:
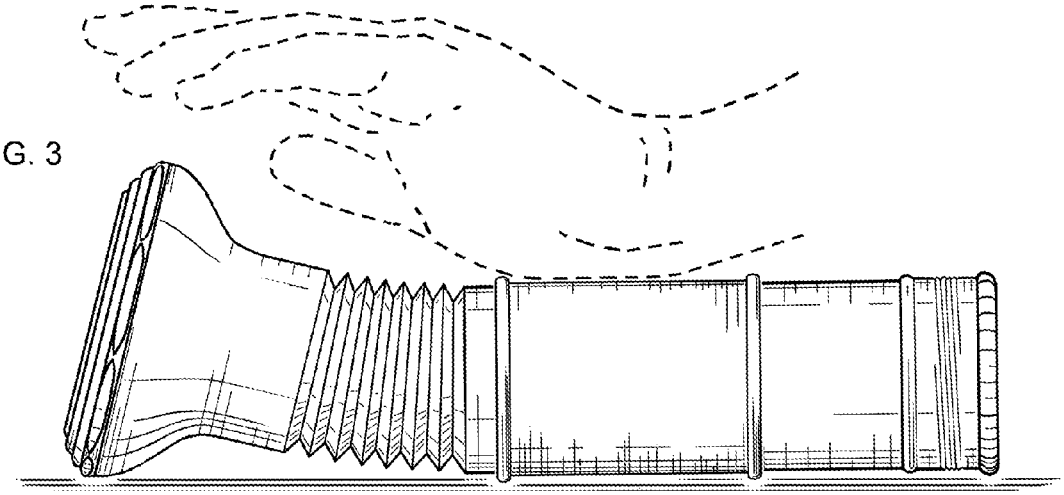
FIG. 3 is a side view of the flashlight bent by outside force to actuate switching. [The drawing of FIG. 3 to appear also on page 1]
Figure 5:
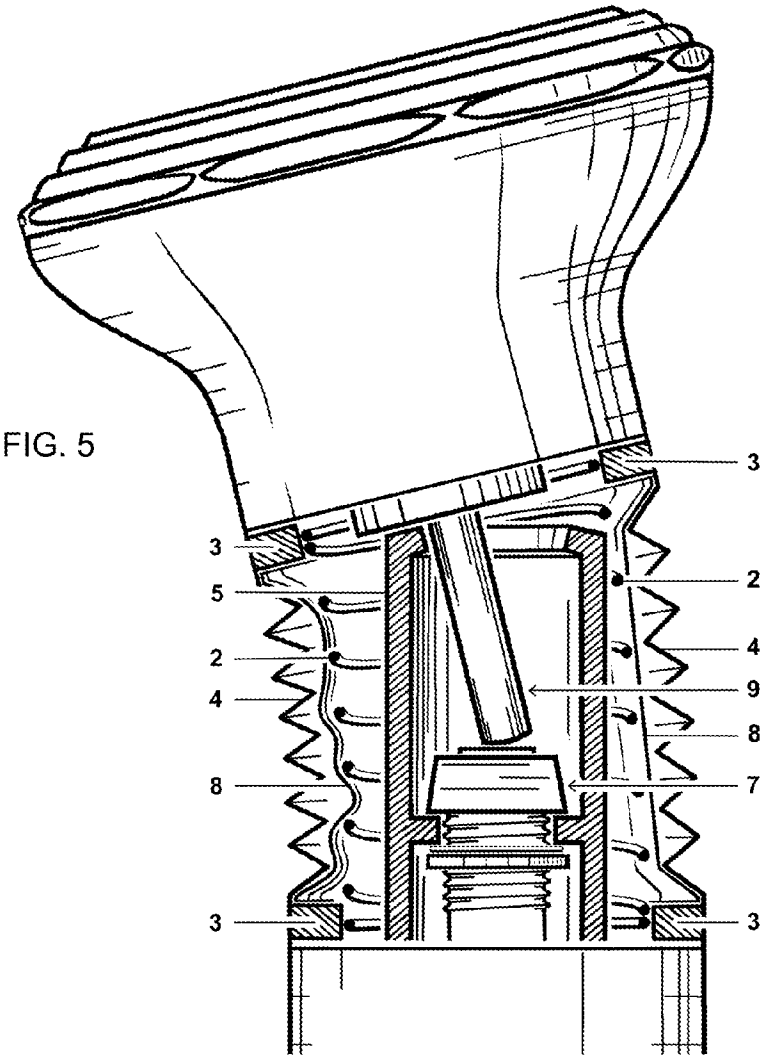
FIG. 5 is a side view of the flexible section of the flashlight in the bent position, with the outer casing partly cut away and some parts shown in section, to show the mechanism for actuation of the switch.
Figure 4:
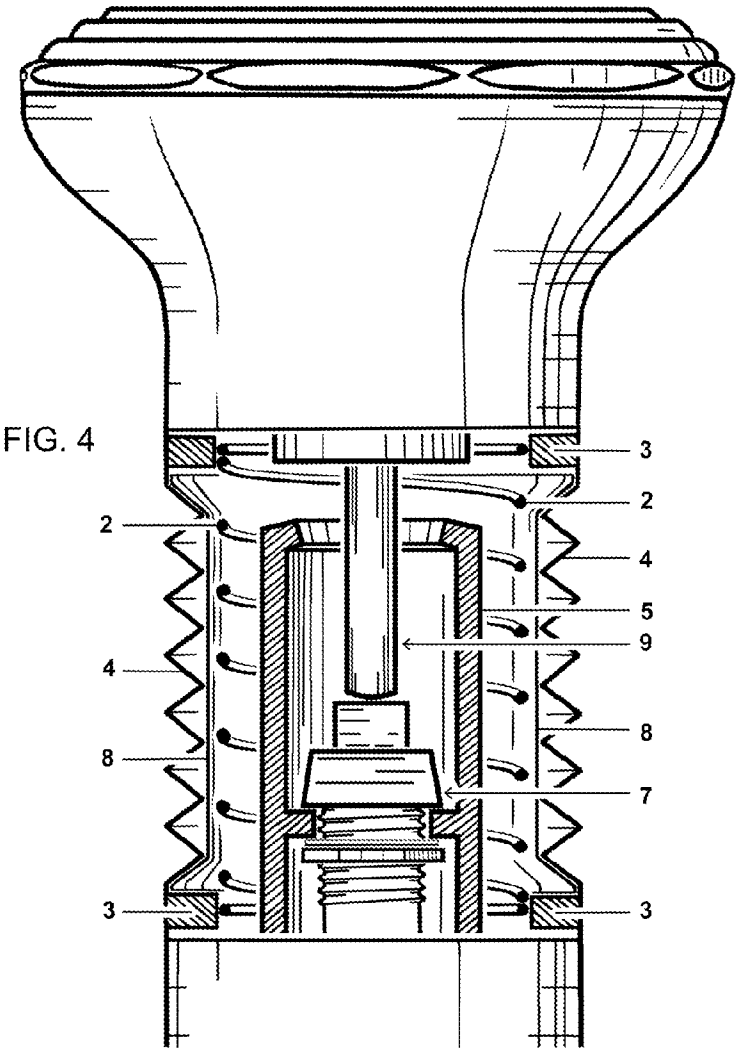
FIG. 4 is a side view of the flexible section of the flashlight in the straight position, with the outer casing partly cut away and some parts shown in section, to show the mechanism for actuation of the switch.

The following detailed description of the invention refers to the accompanying drawings which are a part hereof and which, by way of illustration, show an embodiment employing simple technology to use the force of bending an elongated body, in any direction, to make and break an electrical circuit. In the case of a flashlight, a section 1 of it is made resiliently flexible so that it can be bent in any direction; after the bending force ceases, the bend straightens again spontaneously and is ready for renewed bending and switching.

The flexible section 1 can be made of an elastic material such as rubber or another elastomer, of a metal bellows, or its construction can be based on a coil spring 2 attached to mounts 3 on the two adjoining rigid sections and enclosed in a flexible sleeve 4. A mechanical limiter 5 can be included in the structure to prevent excessive bending. A sheath 6 can be slid over the flexible section 1 to prevent inadvertent switching, for example in a backpack.

In the example shown in the drawings and described in the following, the force of bending is transferred to an inlying pushbutton switch 7. In this illustrative embodiment, the elastic quality of the wall of the flexible section 1 is modified by the incorporation of a flexible but non-stretching layer 8 which prevents stretching, or lengthening, but permits compression, or shortening. This means that when the flexible section 1 is bent, the convex aspect of the bend does not become longer, as would normally be the case, but retains its length, while the concave aspect of the bend is compressed more than it would normally be. The result is that the two rigid sections at either end of the flexible section 1 are moved closer to each other when bending occurs, thereby causing an extension 9 on one rigid section to exert pressure on a pushbutton switch 7 which is mounted on the other rigid section.

Switching can be arranged so that bending turns the light on or off, that is, no switching occurs when the bent section straightens. However, switching can be arranged to provide an additional mode of momentary light by bending the flexible section of the flashlight only slightly to turn the light on and, by relieving the bending pressure, to turn it off again. Furthermore, the invention does not preclude additional means for setting modalities such as light intensity, color, field of lighting and constant or flashing light.

This embodiment is exemplary only and does not limit the invention to the means described for its realization. The technologies that can be employed within the scope of the invention for making and breaking the electrical circuit include but are not limited to arrangements involving electrostatic switches, reed switches, the piezoelectric effect and microcircuitry, or combinations of these.

Dimensions and proportions may be varied; the dimensions and proportions suggested by the drawings were chosen for the sake of lucidity.

The electrical connections between the battery, the switch and the light source are not shown in the drawings because they are self-evident and their depiction would unnecessarily clutter the drawings.

Whereas the invention is described in connection with a specific embodiment and for a particular application, it will be evident that many alternatives, modifications and variations will become apparent to those of ordinary skill in the art in light of the foregoing description. Accordingly, the present invention is intended to embrace all such alternatives, modifications and variations as fall within the scope of the appended claims.

What is claimed is:

1. A cylindrical flashlight or other oblong body comprising: a first rigid section including a light emitter and a second rigid section opposite the first rigid section, wherein a resiliently flexible section extends therebetween, wherein said resiliently flexible section actuates a switched ON position or a switched OFF position when said resiliently flexible section is bent in an arbitrary direction by an application of outside force, wherein the switched ON position or the switched OFF position persists when said resiliently flexible section straightens.

2. The device as defined in claim 1 wherein inadvertent bending and switching is prevented by sliding a rigid sheath over said resiliently flexible section to stiffen said resiliently flexible section.

3. The device as defined in claim 2 wherein said resiliently flexible section becomes shorter when bent.

4. The device as defined in claim 2 wherein bending of said resiliently flexible section causes said resiliently flexible section to shorten, further wherein a non-stretching layer is incorporated in the wall of said resiliently flexible section wherein said non-stretching layer, when the resiliently flexible section is bent, allows a concave aspect of the bend to be compressed and shortened, while a convex aspect retains its original length, resulting in an overall shortening of said resiliently flexible section which moves said rigid sections at either end of the resiliently flexible section toward each other, wherein the resulting pressure between extensions of said two rigid sections actuates switching.

5. The device as defined in claim 2 wherein said resiliently flexible section is made of an elastomer wherein said elastomer is reinforced with fibers to minimize stretching of said resiliently flexible section.

6. The device as defined in claim 1 wherein said resiliently flexible section becomes shorter when bent.

7. The device as defined in claim 1 wherein bending of said resiliently flexible section causes said resiliently flexible section to shorten, further wherein a non-stretching layer is incorporated in the wall of said resiliently flexible section wherein said non-stretching layer, when said resiliently flexible section is bent, allows a concave aspect of the bend to be compressed and shortened, while a convex aspect retains its original length, resulting in an overall shortening of said resiliently flexible section which moves said rigid sections at either end of the resiliently flexible section toward each other, wherein the resulting pressure between extensions of said two rigid sections actuates switching.

8. The device as defined in claim 1 wherein said resiliently flexible section is made of an elastomer wherein said elastomer is reinforced with fibers to minimize stretching of said resiliently flexible section.

* * * * *